US007761026B2

(12) United States Patent
Ishikawa et al.

(10) Patent No.: US 7,761,026 B2
(45) Date of Patent: Jul. 20, 2010

(54) DEVICE FOR FORMING IMAGE AND IMAGE FORMING UNIT USING A SHIELDING MEMBER

(75) Inventors: Masaru Ishikawa, Kanagawa (JP); Takashi Kanagawa, Kanagawa (JP); Akihito Nishimura, Kanagawa (JP); Hiroshi Hashino, Kanagawa (JP); Yuzo Ichikawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 890 days.

(21) Appl. No.: 11/492,932

(22) Filed: Jul. 26, 2006

(65) Prior Publication Data

US 2007/0025755 A1 Feb. 1, 2007

(30) Foreign Application Priority Data

Jul. 27, 2005 (JP) ..... P2005-218041

(51) Int. Cl.
*G03G 21/00* (2006.01)

(52) U.S. Cl. ..... 399/98; 399/99; 399/100; 399/115; 399/172

(58) Field of Classification Search ..... 399/98–100, 399/115, 172

See application file for complete search history.

(56) References Cited

U.S. PATENT DOCUMENTS

2005/0185976 A1* 8/2005 Morimoto et al. ..... 399/50

FOREIGN PATENT DOCUMENTS

| | | | |
|---|---|---|---|
| JP | 63-94263 | | 4/1988 |
| JP | 01217386 A | * | 8/1989 |
| JP | 7-302021 | | 11/1995 |

OTHER PUBLICATIONS

English Language Abstract of JP 01217386 to Yamazaki et al. Dated Aug. 30, 1989.*

* cited by examiner

*Primary Examiner*—David M Gray
*Assistant Examiner*—Ryan D Walsh
(74) *Attorney, Agent, or Firm*—Morgan, Lewis & Bockius LLP

(57) ABSTRACT

An image forming device includes an image carrier, a cleaning device, a charging device and a shielding member. The image carrier carries a toner image thereon. The cleaning device removes a toner on the image carrier. The charging device charges the image carrier. The shielding member is disposed between the cleaning device and the charging device. The shielding member is in contact with the image carrier in an area where the image carrier is charged.

16 Claims, 6 Drawing Sheets

DEVICE FOR FORMING IMAGE AND IMAGE FORMING UNIT USING A SHIELDING MEMBER

BACKGROUND

1. Technical Field

The invention relates to an electrophotographic type image forming device used for a printer, a copying machine, a facsimile or the like, and an image forming unit.

2. Related Art

In an electrophotographic type image forming device for use in a printer, a copying machine or a facsimile machine, an electrostatic latent image formed on the surface of a photosensitive drum functioning as an image carrier is developed (toner-imaging) by toner development, and a toner image is transferred onto a recording sheet to achieve an image.

As such an image forming device is known a device in which electrophotographic devices such as a charging device for uniformly charging the photosensitive drum, a laser exposure unit for writing an electrostatic latent image on the photosensitive drum by light irradiation, a developing device for visualizing the electrostatic latent image on the photosensitive drum with toner, a transfer portion for transferring the toner image formed on the photosensitive drum to a recording sheet, a drum cleaning device for removing residual toner on the photosensitive drum, etc. are successively disposed around the periphery of the photosensitive drum along the rotational direction.

The charging device may be constructed by a corona charging device such as a scorotron. A method of charging the photosensitive body on the surface of the photosensitive drum under a non-contact state by corona discharge as described above is frequently used for a high-speed output type image forming device. Furthermore, as a cleaning device, generally used is a so-called blade type of mechanically scraping toner while a cleaning blade formed of elastic material such as urethane rubber is pressed against the surface of the photosensitive drum.

SUMMARY

According to one aspect of the invention, an image forming device includes an image carrier, a cleaning device, a charging device and a shielding member. The image carrier carries a toner image thereon. The cleaning device removes a toner on the image carrier. The charging device charges the image carrier. The shielding member is disposed between the cleaning device and the charging device. The shielding member is in contact with the image carrier in an area where the image carrier is charged.

BRIEF DESCRIPTION OF THE DRAWINGS

Exemplary embodiments of the invention will be described in detail based on the following figures, wherein:

FIG. 4 shows the mount structure of a seal material according to another exemplary embodiment which is different in construction of the seal material.

FIG. 5 shows a seal material according to another exemplary embodiment, FIG. 6 shows a seal material according to another exemplary embodiment.

DETAILED DESCRIPTION

Exemplary embodiments of the invention will be described in detail with reference to the accompanying drawings.

Figure 1:
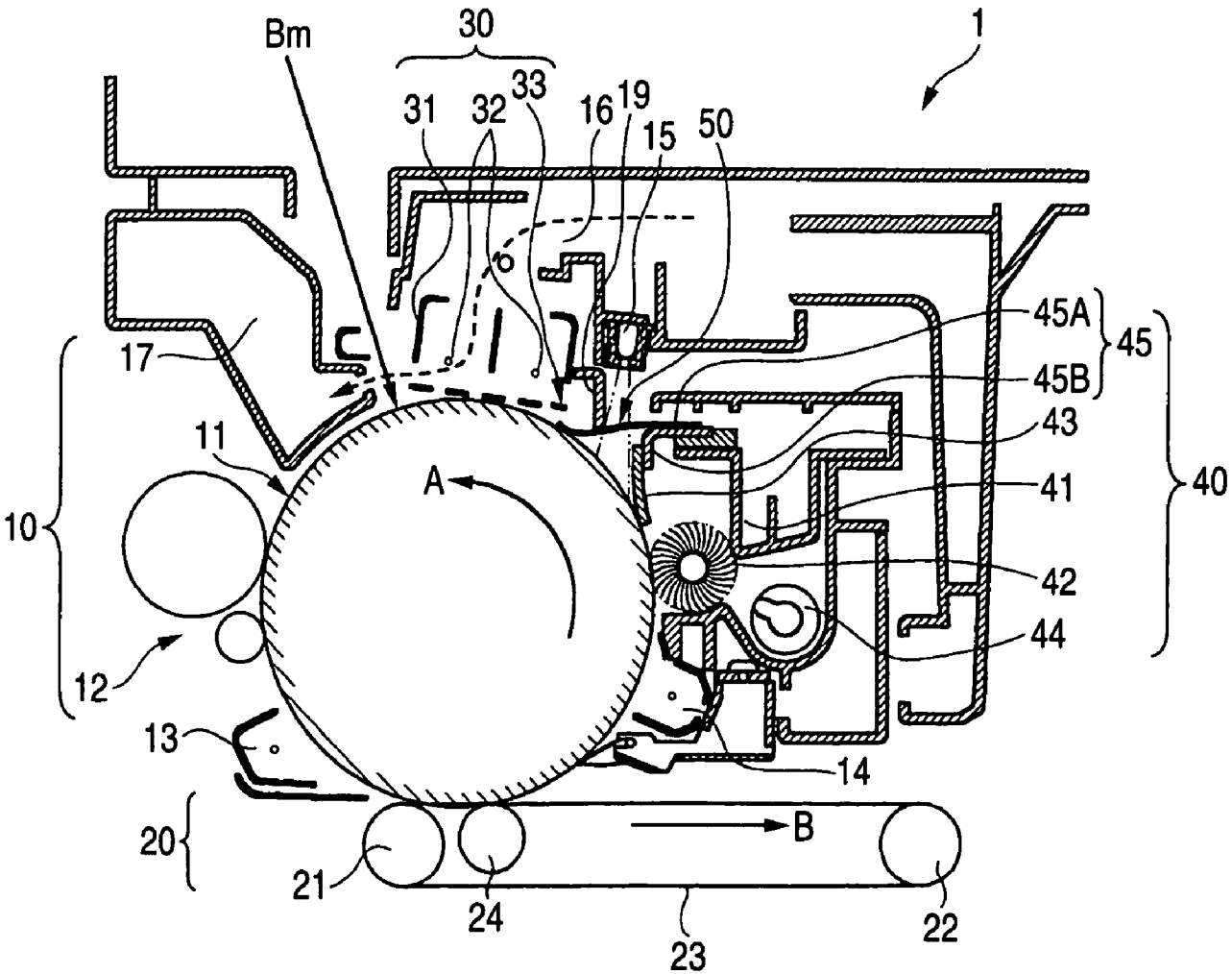
FIG. 1 is a diagram showing the configuration of an image forming device to which an exemplary embodiment of the invention is applied.

FIG. 1 is a diagram showing the configuration of an image forming device 1 to which this exemplary embodiment of the invention is applied.

The image forming device 1 shown in FIG. 1 is equipped with an image forming portion 10 for forming a toner image, and a transfer portion 20 for transferring the toner image formed in the image forming portion 10 to a recording sheet (not shown). Although not shown, the image forming device 1 is further equipped with a fixing portion for fixing onto the recording sheet the toner image transferred to the recording sheet by the transfer portion 20, and the recording sheet feeding system for feeding the recording sheet.

The image forming portion 10 is equipped with a photosensitive drum 11 as an image carrier, which is rotatable in the direction of an arrow A in FIG. 1; a charging device 30 for charging the photosensitive drum 11 to predetermined potential, and a laser exposing unit (not shown, but only a laser optical path Bm is shown) for forming an electrostatic latent image on the photosensitive drum 11 by irradiation of light. The image forming portion 10 is equipped with a developer 12 for developing the electrostatic latent image on the photosensitive drum 11 into a visible image with black toner stored in the developer 12, and PTC (Pre-Transfer Corotron) 13 for adjusting the charging amount of the toner for constituting the toner image formed on the photosensitive drum 11 before the transfer. Furthermore, the image forming portion 10 is equipped with PCC (Pre-Cleaning Corotron) 14 for removing residual charges (charges having the same polarity as transfer electric field) on the photosensitive drum 11 after the transfer, a cleaning device 40 for cleaning the residual toner on the photosensitive drum 11, and a discharging lamp 15 for eliminating charges on the surface of the photosensitive drum 11 by irradiation of light by the cleaning. An air blowing duct 16 is disposed on the upper side of the charging device 30 along the axial direction of the charging device 30. Furthermore, a suction duct 17 is disposed between the laser optical path Bm from the laser exposing unit and the developer 12.

In the photosensitive drum 11, an organic photosensitive layer made of material which is charged to have a negative polarity is formed on the surface of a thin metal cylindrical drum. The photosensitive drum 11 is rotated by a drum driving motor (not shown).

The charging device 30 is a scorotron charging device. The charging device 30 is configured so that two charging wires 32 are strung in a shield case 31 that is substantially E-shaped in section and defines a front opening at a position facing the photosensitive drum 11. Furthermore, a grid 33 is provided at the front opening of the shield case 31. The grid 33 is disposed along the axial direction of the photosensitive drum 11.

A high voltage power source (not shown) for applying a DC high voltage is connected to the charging wires 32. A constant voltage element such as a varistor is connected to the shield case 31 and the grid 33 to hold the shield case 31 and the grid 33 to fixed potential.

The grid 33 is constructed by a metal mesh having a lot of air holes.

The charging device 30 charges the photosensitive layer of the photosensitive drum 11 to −700V.

The developer 12 develops the electrostatic latent image on the photosensitive drum 11 according to a reversal developing method by using small particle-diameter EA toner formed by the emulsion aggregation method (EA method). Accordingly, the toner is of a negative-polarity charging type. A predetermined amount of external additive such as silicon fine particles is added to the toner.

Furthermore, PTC 13 and PCC 14 are constructed by corotron charging devices, which are disposed in non-contact with the photosensitive drum 11. PTC 13 and PCC 14 carry out negative-polarity discharge.

The drum cleaning device 40 is equipped with a cleaning brush 42 disposed in a cleaner housing 41 rotatably, and a cleaning blade 43 disposed on the downstream side of the cleaning brush 42 in the rotational direction of the photosensitive drum 11 so as to be in contact with the photosensitive drum 11 under pressure in the counter direction, which is the upstream direction in the rotational direction.

An auger 44 is disposed on the inner back side of the clear housing 41 (at the opposite side to the photosensitive drum 11) to feed waste powder such as toner removed by the cleaning brush 42 and the cleaning blade 43 to a recovery bottle (not shown).

The cleaning blade 43 is made of urethane rubber having a predetermined hardness, designed like a plate having a predetermined thickness, and provided to the cleaner housing 41 through a blade bracket 45. The tip of the cleaning blade 43 comes into contact with the photosensitive drum 11 and elastically deforms, so as to be in contact with the photosensitive drum 11 under pressure by elastically restoring force.

The blade bracket 45 has an L-shape in section. A fixing side 45A, which is one side of the blade bracket 45, is mounted on the cleaner housing 41. The fixing side 45A is fixed horizontally to an upper portion of an opening portion of the cleaner housing 41, which faces the photosensitive drum 11. The other support side 45B vertically extends so as to close the opening portion of the cleaner housing 41. The support side 45B, which extends vertically, supports the cleaning blade 43 vertically.

Accordingly, gap between the cleaner housing 41 and the photosensitive drum 11 is closed by the blade bracket 45 and the cleaning blade 43.

Furthermore, a seal material 50 according to this exemplary embodiment of the invention is mounted to the drum cleaning device 40. The seal material 50 will be described in detail later.

The discharging lamp 15 is an LED lamp for emitting light having a predetermined wavelength (discharging light). The discharging lamp 15 is disposed between the drum cleaning device 40 and the charging device 30. The discharging lamp 15 is configured to irradiate with the discharging light the surface of the photosensitive drum 11 disposed between the drum cleaning device 40 and the charging device 30. A light shielding plate 19, which extends vertically, is disposed on the charging device 30 side with respect to the position of the discharge lamp 15. The light shielding plate 19 regulates the light irradiation range on the charging device 30 side so that it is prevented that the charging area of the photosensitive drum 11 irradiated with the irradiation light of the discharging lamp 15.

Outside air is introduced into the air blowing duct 16 disposed on the upper side of the charging device 30 by a fan (not shown), and blown to the opening portion defined in the upper portion of the charging device 30. The suction duct 17 is connected to a blower (not shown), and suctions air from its suction port facing the charging device 30. Accordingly, as indicated by a broken line of FIG. 1, the outside air introduced from the air blowing duct 16 passes through the charging device 30, and is suctioned into the suction duct 17. Ozone, nitrogen oxide, etc. generated by corona discharge of the charging device 30 are suctioned into the suction duct 17, subjected to a cleaning treatment by a filter (not shown) and then discharged to the outside.

The transfer portion 20 is equipped with a transfer belt 23, which is suspended between two rolls 21 and 22 so as to be rotatable in the direction of an arrow B, and a transfer roll 24 disposed so as to be in contact with the transfer belt 23 at a position where the photosensitive drum 11 and the transfer belt 23 face each other.

The image forming device 1 thus configured forms an image as follows.

First, the charging device 30 charges the photosensitive layer on the surface of the rotationally-driven photosensitive drum 11, and then the irradiated exposure beam Bm forms an electrostatic latent image in the charged photosensitive layer. The developer 12 develops and visualizes the electrostatic latent image formed on the photosensitive drum 11 into a visible image (toner image). PC 13 uniforms charging polarity of the toner image formed on the photosensitive drum 11. Then, the rotation of the photosensitive drum 11 feeds the toner image to a transfer position at which the photosensitive drum 11 is in contact with the transfer belt 23. A transfer bias applied between the photosensitive drum 11 and the transfer roll 24 transfers the toner image formed on the photosensitive drum 11 onto a recording sheet synchronously-fed by the recording sheet feeding system at the transfer position where the photosensitive drum 11 and the transfer belt 23 are in contact with each other. After the transfer, PCC 14 charges the residual toner remaining on the photosensitive drum 11, the drum cleaning device 40 removes the residual toner. The discharge lamp 15 eliminates charges on the surface of the photosensitive drum 11 after the cleaning. Then, the image forming device 1 waits next image formation.

Furthermore, the transfer belt 23 transports the recording sheet to which the toner image is transferred, and the fixing portion (not shown) fixes the toner imager by heat and pressure, and then the recording sheet is discharged.

Next, a seal material functioning as the seal member disposed between the charging device 30 and the drum cleaning device 40 and a mounting structure of the seal material will be described in detail.

Figure 2A:
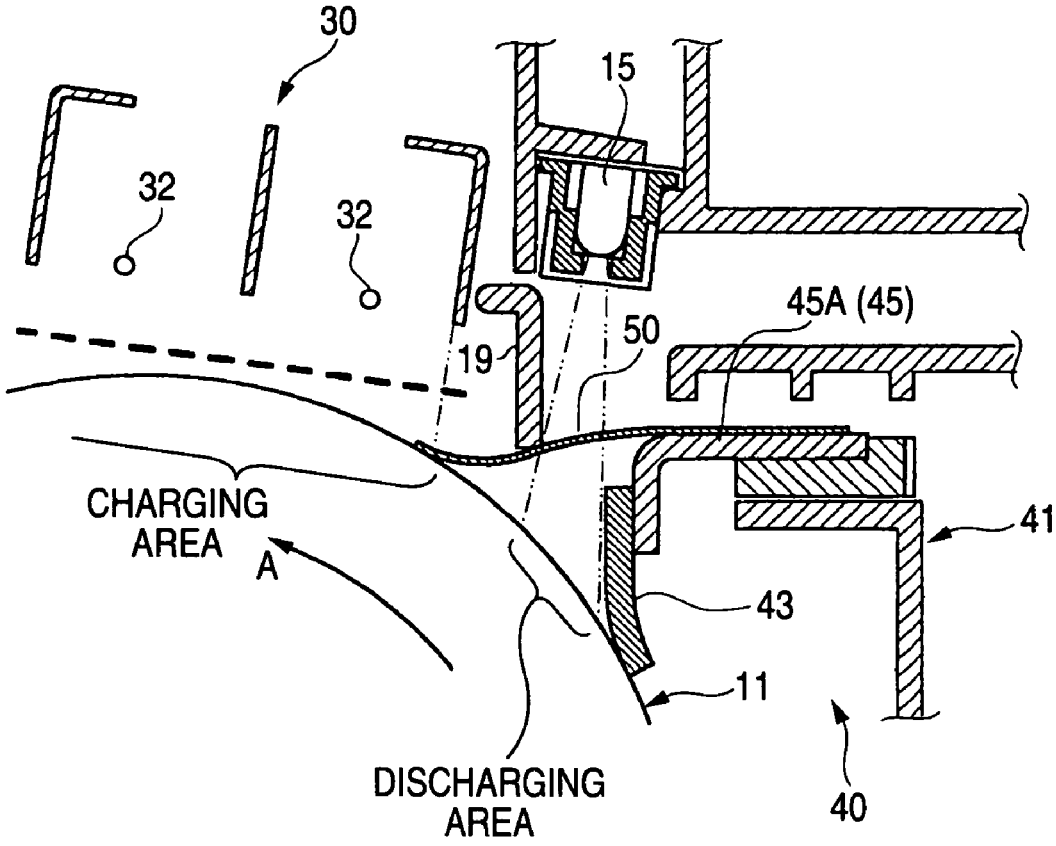
FIG. 2 shows a mount structure of a seal material, (a) is an enlarged view showing a mount site, and (b) is a partially enlarged view showing a contact portion of the seal material to a photosensitive drum.
Figure 2B:
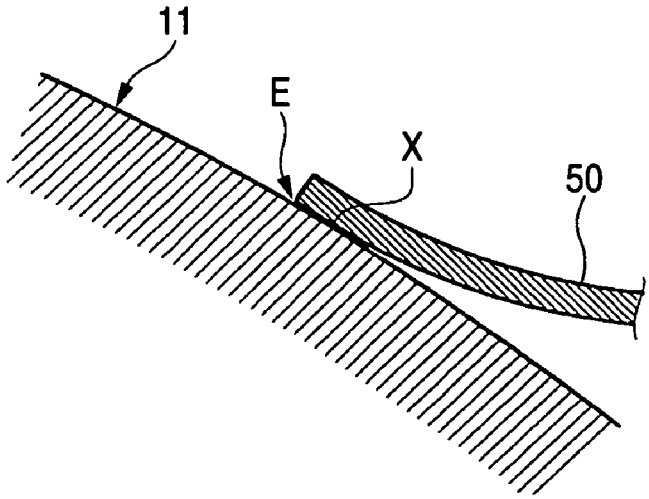
Figure 3:
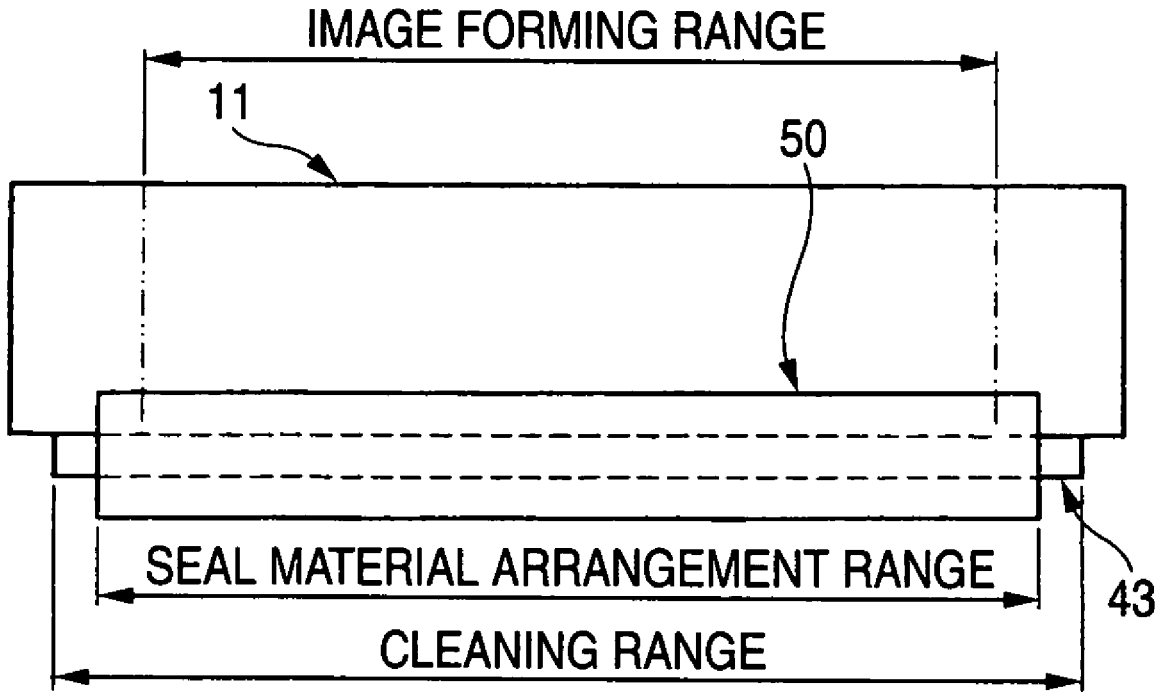
FIG. 3 is a diagram showing the concept of the mount positional relationship of the seal material.

FIG. 2 shows the mount structure of the seal material 50. FIG. 2A is an enlarged view of the mounted position. FIG. 2B is a partially enlarged view of the contact position between the seal material 50 and the photosensitive drum 11. FIG. 3 is a diagram showing the arrangement positional relationship of the seal material 50 in the axial direction of the photosensitive drum 11.

The seal material 50 is mounted to the drum cleaning device 40, and is disposed between the drum cleaning device 40 and the charging device 30. The tip portion of the seal material 50 is in contact with the surface of the photosensitive drum 11, to thereby shield toner and external additive, which scatter from the drum cleaning device 40 side, from flowing to the charging device 30 side.

The seal material 50 is a flat sheet formed of material (for example, urethane), which is transparent to the irradiation light of the discharging lamp 15 and has a high wear resistance. The thickness of the seal material 50 may be 0.2 mm, for example, and have predetermined elasticity.

The seal material 50 is fixed to the upper surface of the fixing side 45A of the blade bracket 45, which is fixed to the cleaner housing 41, by screwing or adhesive bonding at the base portion of the seal material 50. The tip of the seal material 50 interferes with the photosensitive drum 11 a predetermined distance. A lower end of the light shielding plate 19, which is located in middle and upper portions in FIG. 2A, regulates an arrangement shape of a portion of the seam material 50, which is close to its tip end. As a result, the potion of the seal material 50, which is close to the tip end, is elastically bent to have a concave shape.

That is, in this configuration, the light shielding plate 19 also functions as a posture regulating member, which regulates the posture of the seal material 50, and interferes with the area where the seal material 50 is disposed so as to bend the seal material 50 in the concave shape. The posture regulating member may be separately from and independently of the light shielding plate 19 without being used as the light shielding plate 19.

As shown in FIG. 2B, the seal material 50 disposed as described above is in contact with the photosensitive drum 11 at a position X, which is shifted from the edge E on the lower side of the tip (the side facing the photosensitive drum 11) to the base-portion side by a predetermined distance. The contact portion of the seal material 50 is pressed against the surface of the photosensitive drum 11 by elastic restoring force. That is, the lower surface of the tip portion of the seal material. 50 is brought into contact with the photosensitive drum 11 under pressure, and the edge E of the most tip end is separated from the surface of the photosensitive drum 11.

Furthermore, the contact position between the seal material 50 and the photosensitive drum 11 is located on the downstream side of the irradiation area (discharging area) of the discharging lamp 15 in the rotational direction of the photosensitive drum 11 (an arrow A in the figure) and on the upstream side of the charging area of the charging area of the charging device 30. Accordingly, the seal material 50 is disposed so as to across the irradiation area (discharging area) of the discharging lamp 15. As described above, the seal material 50 is transparent to the irradiation light of the discharging lamp 15, and thus the seal material 50 does not obstruct the discharging action.

Here, the length of the seal material 50 in the axial direction of the photosensitive drum 11 is equal to or longer than an image forming range on the photosensitive drum 11 as shown in FIG. 3. Also, the length of the seal material 50 is shorter than that of the cleaning blade 43 of the drum cleaning device 40 by a predetermined length. That is, the side ends of the seal material 50 are closer to the center of the image forming range than the side ends of the cleaning blade 43 by a predetermined length.

The photosensitive drum 11, the charging device 30, PCT 13 (see FIG. 1), PCC 14 (see FIG. 1), the drum cleaning device 40 and the seal material 50 are integrated with each other and constitute a process cartridge functioning as an image forming unit. This image forming unit is exchangeable in the form of a process cartridge.

This exemplary embodiment is applied to the image forming device in which the discharging operation of the photosensitive drum 11 is carried out by the irradiation light emitted from the discharging lamp 15 disposed between the drum cleaning device 40 and the charging device 30. Therefore, the seal material 50 is transparent to the irradiation light. However, for example, the discharging of the photosensitive drum 11 may be carried out by a discharging roll connected to the earth. Also, it is unnecessary that the seal material 50 is transparent, even if the discharging lamp is used while being disposed at a different place.

Next, another exemplary embodiment in which the configuration of the seal material is different will be described.

Figure 4A:
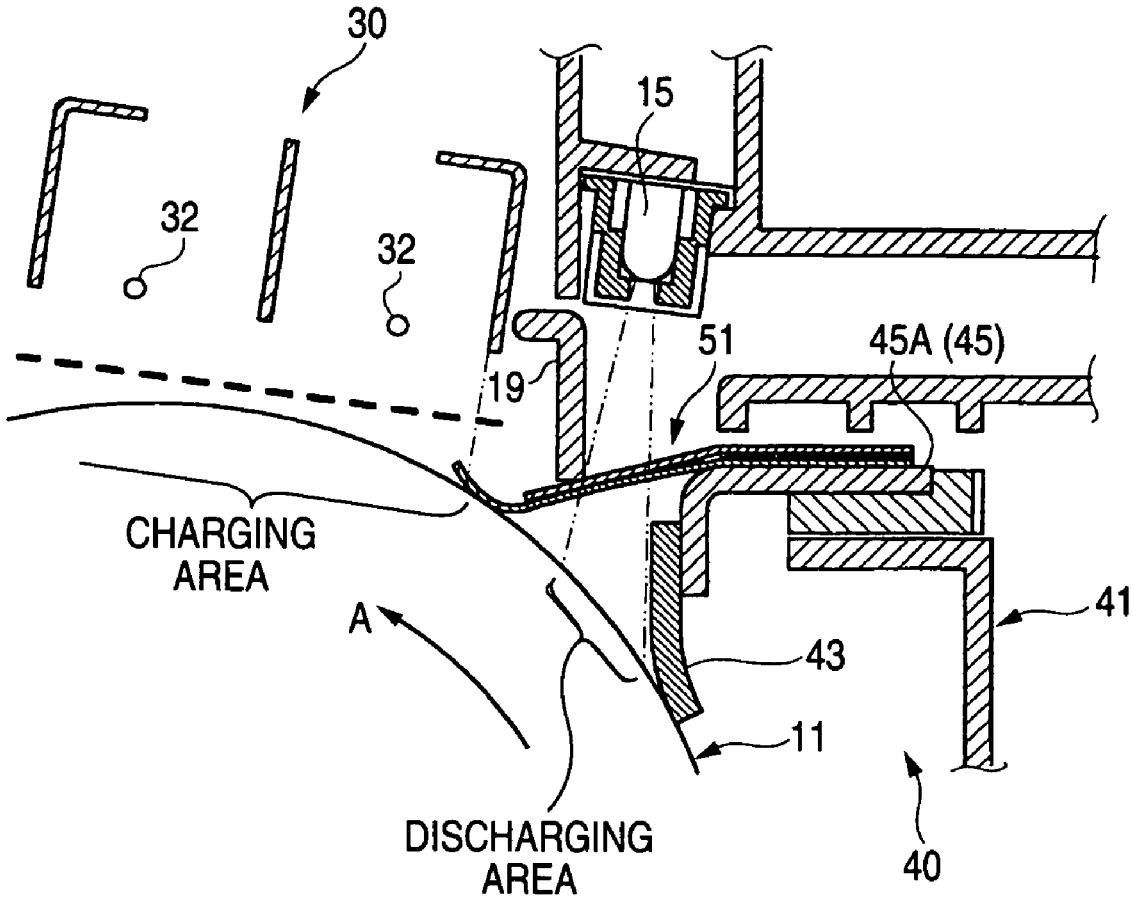
FIG. 4A is an enlarged cross-sectional view showing the mount site of the image forming device.
Figure 4B:
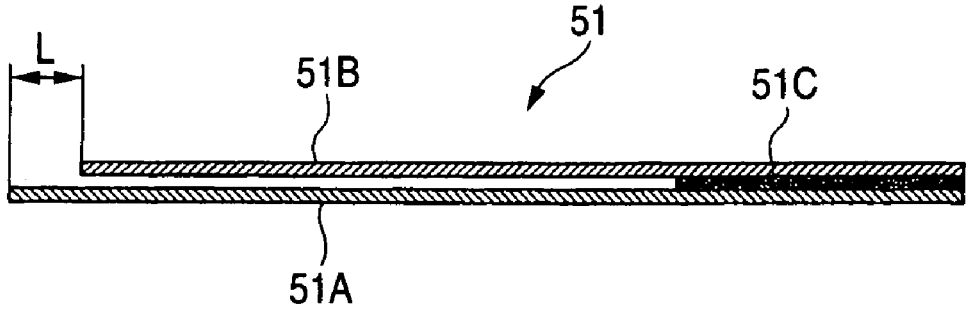
FIG. 4B is a cross-sectional view of the seal material.

FIG. 4A is an enlarged cross-sectional view of a mount position of the image forming device having a seal material 51 whose configuration is different from that of the above-described exemplary embodiment. FIG. 4B is a cross-sectional view of the seal material 51. The components having the same functions as the above-described exemplary embodiment are designated by the reference numerals in the figures, and the description thereof will be omitted.

The seal material 51 shown in FIG. 4 is configured by superposing a press plate 51B functioning as a press plate member or a second member, on a seal plate 51A functioning as a seal plate member or a first member.

The seal plate 51A on the lower side is made of a material, such as polyurethane, having a predetermined flexible elasticity. The press plate 51B on the upper side is higher in rigidity than the seal plate 51A. In order to make the press plate 51B higher in rigidity than the seal plate 51A, the press plate 51B is made of a material having high rigidity such as a polycarbonate. Specifically, the seal plate 51A may be formed of a polyurethane sheet having 0.2 mm, and the press plate 51B may be formed of polycarbonate of 0.3 mm. They may be formed of the same material, but have different thicknesses. For example, the seal plate 51A may be formed of a polyurethane sheet of 0.2 mm, and the press plate 51B may be formed of a polyurethane sheet of 0.3 mm.

The seal plate 51A and the press plate 51B are made to integrally adhere to each other by adhesion (adhesive layer 51C) such as pressure-sensitive adhesion or welding, at the base portion at which the seal material 51 is fixed to the drum cleaning device 40. The tip portion of the seal plate 51A and the tip portion of the press plate 51B excluding the base portions thereof are elastically deformable independently of each other.

The tip of the press plate 51B is shorter than the tip of the seal plate 51A by a predetermined length L (for example, 2 mm to 10 mm). One end portion (base portion) of the seal plate 51A and one end portion (base portion) of the press plate 51B are aligned with each other, and the seal plate 51A is longer than the press plate 51B.

As shown in FIG. 4A, the seal material 51 is fixed to the upper surface of the fixing side 45A of the blade bracket 45 of the drum cleaning device 40 at the base portion of the seal material 51 by screwing or adhesion. The upper surface of the press plate 51B is in contact with the light shielding plate 19, so that the light shielding plate 19 regulates the position of the press plate 51B and that the tip of the press plate 51B presses the seal plate 51A. Accordingly, the lower surface of the tip portion of the seal plate 51A is in contact with the photosensitive drum 11 with being bent in a concave shape.

That is, in this configuration, the light shielding plate 19 regulates the position of the seal plate 51A through the press plate 51B to bend the seal plate 51A in the concave shape. Therefore, the lower surface of the tip portion of the seal plate 51A is brought into contact with the photosensitive drum 11 under pressure.

Next, a seal material 52 according to an exemplary embodiment shown in FIG. 5 will be described.

Figure 5A:
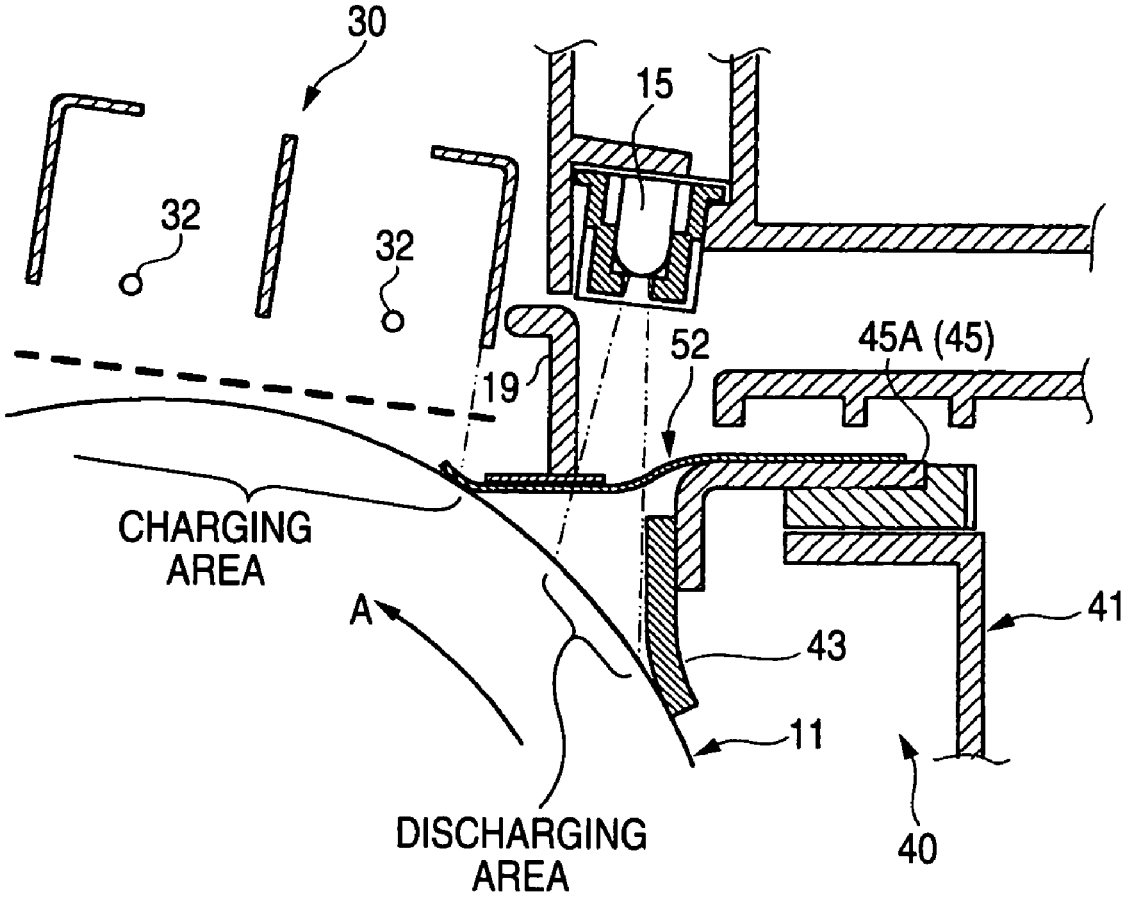
FIG. 5A is an enlarged view showing the mount site of the seal material.
Figure 5B:
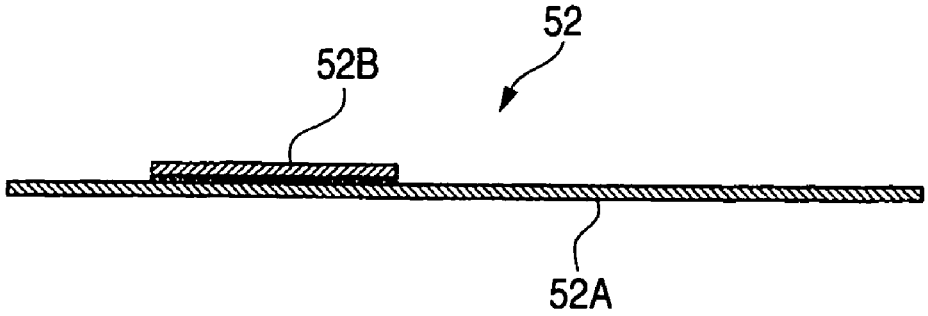
FIG. 5B is an enlarged cross-sectional view of the seal material.

FIG. 5A is an enlarged view of a mount portion of the seal material 52. FIG. 5B is an enlarged cross-sectional view of the seal material 52.

In the seal material 52 shown in FIG. 5, a backing plate 52B is adhesively attached to a pressed portion of a seal plate 52A, which is pressed by the light shielding plate 19.

The backing plate 52B is made of a material having higher rigidity than the seal material 52. For example, in the case of the same material, the backing plate 52B is thicker than the seal material 52. Specifically, the seal material 52 may be formed of an urethane sheet having 0.2 mm, and the backing plate 52B may be formed of an urethane sheet having 0.3 mm.

The backing plate 52B is mounted on only the pressed portion of the seal plate 52A, which is pressed by the light shielding plate 19. The backing plate 52B is mounted on neither the tip portion, which is in contact with the photosensitive drum 11, nor the base portion mounted on the drum cleaning device 40.

Figure 6A:
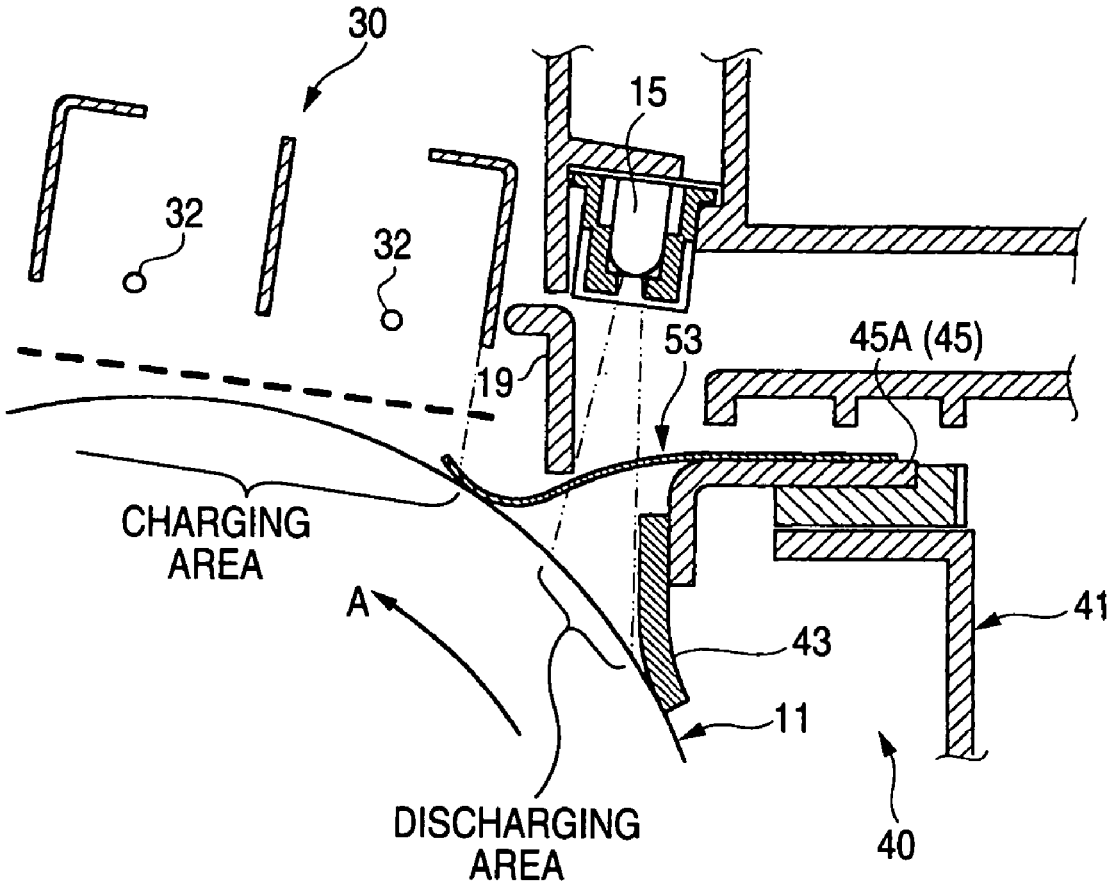
FIG. 6A is an enlarged view showing a mount site of the seal material.
Figure 6B:
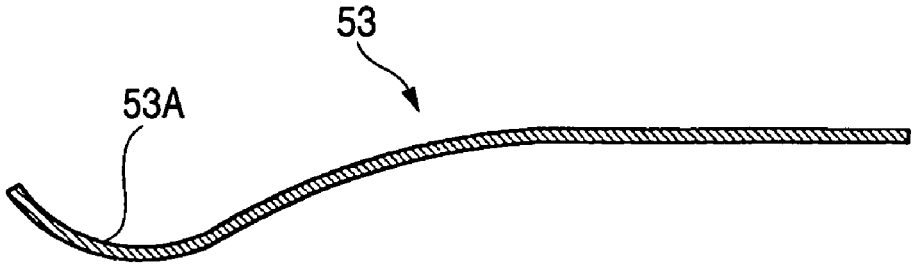
FIG. 6B is an enlarged cross-sectional view of the seal material.

FIG. 6 shows a seal material 53 of a different exemplary embodiment. FIG. 6A is an enlarged view of the mount portion of the seal material 53. FIG. 6B is an enlarged cross-sectional view of the seal material 53.

The seal material 53 shown in FIG. 6 is formed so that its tip is bent upwardly in advance. According to this seal material 53, the lower surface of the seal material 53 can be brought into contact with the photosensitive drum 11 particularly without pressing the seal material 53 by a posture regulating member while the edge of the tip of the seal material is separated from the photosensitive drum 11.

The invention is not limited to the above-described exemplary embodiments. In the exemplary embodiments, the invention is applied to the monochromatic image forming device having one photosensitive drum as an image carrier. However, it is needless to say that the invention may be applied to an image forming device having a belt type image carrier, a color image forming device having a rotational type developing device, etc.

What is claimed is:

1. An image forming device comprising:

an image carrier that carries a toner image thereon;

a cleaning device that removes a toner on the image carrier;

a charging device that charges the image carrier; and a shielding member disposed between the cleaning device and the charging device, the shielding member being in contact with the image carrier in an area where the image carrier is charged, the shielding member being made of a material which is transparent to the irradiation light.

2. The device according to claim 1, wherein a base portion of the shielding member is fixed to the cleaning device.

3. The device according to claim 2, wherein:

the shielding member comprises a first member and a second member, and the first member comprises two surfaces, one of the surfaces being in contact with the image carrier, the other of the surfaces facing the second member.

4. The device according to claim 3, wherein:

the second member is bonded to the first member at a base portion of the second member, the base portion being a side that does not contact with the image carrier, and an end portion of the second member is closer to the base portion of the second member than one end portion of the first member.

5. The device according to claim 1, further comprising:

a posture regulating member that is in contact with an opposite surface of the shielding member to the image carrier.

6. The device according to claim 5, wherein:

the shielding member comprises a first member and a second member, and the first member comprises two surfaces, one of the surfaces being in contact with the image carrier, the other of the surfaces facing the second member.

7. The device according to claim 6, wherein:

the second member is bonded to the first member at a base portion of the second member, the base portion being a side that does not contact with the image carrier, and an end portion of the second member is closer to the base portion of the second member than one end portion of the first member.

8. The device according to claim 1, wherein:

the shielding member comprises a first member and a second member, and the first member comprises two surfaces, one of the surfaces being in contact with the image carrier, the other of the surfaces facing the second member.

9. The device according to claim 8, wherein:

the second member is bonded to the first member at a base portion of the second member, the base portion being a side that does not contact with the image carrier, and an end portion of the second member is closer to the base portion of the second member than one end portion of the first member.

10. An image forming device comprising;

an image carrier that carries a toner image thereon;

a cleaning device that removes a toner on the image carrier;

a charging device that charges the image carrier;

a discharging device disposed between the cleaning device and the charging device, the discharging device that irradiates the image carrier with light to eliminate charges from the image carrier; and a shielding member disposed between the cleaning device and the charging device, the shielding member being in contact with the image carrier in an area where the image carrier is charged, the shielding member made of a material, which is transparent to the irradiation light of the discharging device.

11. The device according to claim 10, further comprising:

a posture regulating member that is in contact with an opposite surface of the shielding member to the image carrier.

12. The device according to claim 11, wherein:

the shielding member comprises a first member and a second member, and the first member comprises two surfaces, one of the surfaces being in contact with the image carrier, the other of the surfaces facing the second member.

13. The device according to claim 12, wherein:

the second member is bonded to the first member at a base portion of the second member, and an end portion of the second member is closer to the base portion of the second member than one end portion of the first member.

14. The device according to claim 10, wherein:

the shielding member comprises a first member and a second member, and the first member comprises two surfaces, one of the surfaces being in contact with the image carrier, the other of the surfaces facing the second member.

15. The device according to claim 14, wherein:

the second member is bonded to the first member at a base portion of the second member, and an end portion of the second member is closer to the base portion of the second member than one end portion of the first member.

16. A cleaning device unit comprising:

a shielding member disposed between a cleaning device and a charging device, the shielding member being in contact with the image carrier in an area where an image carrier is charged by the charging device, the shielding member made of a material, which is transparent to irradiation light of the discharging device, the cleaning device being detachable from an image forming device.

* * * * *